US010040304B1

(12) United States Patent
Hull et al.

(10) Patent No.: US 10,040,304 B1
(45) Date of Patent: Aug. 7, 2018

(54) PRINT HEAD COOLING JACKET

(71) Applicant: ENCORE WIRE CORPORATION, McKinney, TX (US)

(72) Inventors: Andrew P. Hull, McKinney, TX (US); Jeffrey T. Mileger, McKinney, TX (US)

(73) Assignee: Encore Wire Corporation, McKinney, TX (US)

( * ) Notice: Subject to any disclaimer, the term of this patent is extended or adjusted under 35 U.S.C. 154(b) by 0 days.

(21) Appl. No.: 15/612,876

(22) Filed: Jun. 2, 2017

Related U.S. Application Data

(60) Provisional application No. 62/344,776, filed on Jun. 2, 2016.

(51) Int. Cl.
*B41J 29/377* (2006.01)

(52) U.S. Cl.
CPC ..... *B41J 29/377* (2013.01)

(58) Field of Classification Search
CPC ..... B41J 29/377
See application file for complete search history.

(56) References Cited

U.S. PATENT DOCUMENTS 6,336,696 B1 * 1/2002 Ellson ..... B41J 2/14008 347/17
2010/0309244 A1 * 12/2010 Yamada ..... B41J 2/0456 347/17
2016/0288554 A1 * 10/2016 Nakamura ..... B41J 2/2146

* cited by examiner

*Primary Examiner* — Jason Uhlenhake
(74) *Attorney, Agent, or Firm* — Warren Rhoades LLP

(57) ABSTRACT

An apparatus for cooling a print head implemented on a wire and cable manufacturing line, the apparatus comprising a sleeve, wherein the sleeve has an internal portion and an external portion and wherein the sleeve forms an internal void marginally larger than the size of the print head and wherein the sleeve further comprises an elongated surface; a front surface connected to the elongated surface, wherein the front surface comprises an ink outlet opening; a rear surface connected to the elongated surface, wherein the rear surface comprises a cable opening; a channel connected to the internal portion of the sleeve, wherein the channel comprises an open side facing the internal void and wherein the channel on the internal portion of the sleeve extends from the rear to the front of the sleeve; an air inlet compartment in communication with the channel and enclosed by the rear surface; an air inlet in communication with the air inlet compartment; and an exhaust channel connected to the sleeve and extending from the front surface to the rear surface along the elongated surface and connected to the channel at the front of the sleeve.

25 Claims, 12 Drawing Sheets

PRINT HEAD COOLING JACKET

CROSS-REFERENCE TO RELATED APPLICATIONS

This application claims priority benefit to U.S. Provisional Patent Application No. 62/344,776, filed Jun. 2, 2016 which is fully incorporated by reference herein.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The present invention relates in general to electrical wire and cable, and more particularly, to the systems and methods for cooling the printer head used to apply a print legend on electrical wire and cable.

2. Description of Related Art

Wire and cable products are typically manufactured and delivered on spools, reels or packages. To assist the operator in identifying the specific wire or cable, wire and cable products typically have a variety of specifications that are printed along the length of the product in the form of a "print legend." The print legend contains information about the product such as the size, product type, temperature rating, safety certifications, manufacturing line or personnel, date and time of manufacture, and other product ratings denoting flame resistance, chemical resistance, etc. In many instances, the print legends are required on the wire and cable products. One prior art method includes the use of ink-jet print technology to print the desired text on the product composed of dot-matrix lettering.

A wire and cable manufacturing line is capable of producing several different configurations of products. The operator must have available information required to configure the manufacturing line for each product type. For example, on an insulation extrusion line, this information may include conductor, insulation, and jacket thicknesses, compound specifications, equipment temperature settings, line speeds, tooling sizes, sparker voltages, etc.

Typical ink-jet printers include two components: a main enclosure and a print head. The main enclosure houses the ink cartridges, mixing and pumping equipment and primary electronics for controlling and programming the ink-jet printer. The print head is mounted external of the main enclosure and prints the print legend in dot matrix lettering onto the products as the products pass by during the extrusion and manufacturing processes. The print head is typically connected to the main enclosure by a thick cable that is mounted on the rear of each component and provides power and ink to the head. The main enclosure has an internal exhaust system that protects its components from overheating and the extrusion or manufacturing line may include an additional exhaust unit located on each line to assist with cooling the ink-jet printer. These cooling systems are present as the ink-jet print heads are very sensitive and prone to clogging, especially in warm environments. When temperatures are not optimal, the ink does not disperse properly and will block the outlet of the head requiring a technician to halt the production line and to disassemble and clean the printer and print head. When ambient temperatures exceed 90° F., this maintenance operation may necessarily be performed multiple times an hour.

If an issue with the print head causes the lettering to be distorted or not applied to the product at all, the product may be scrapped. If a print head is unable to run for long periods of time without clogging and reliably applying print, the extrusion and manufacture of large orders of wire and cable products may be extremely difficult.

One prior art method directed toward cooling of the ink-jet printer includes providing a small tube bundled in the cable from the enclosure to the print head that can be connected to a low pressure air pump to provide a flow of air that will reduce the frequency of clogging. While this does slightly increase the time between required cleaning procedures, it does not completely eliminate the clogging problem. Printer manufacturers also provide hosing that connects to the exhaust outlet of the main enclosure and directs the flow over the surface of the print head in an effort to extend the cooling function, but the design does not provide enough air flow to cool and tends to catch heat coming off of the extrusion line, exacerbating the problem. Additionally, exhaust systems may be installed over each work area, but the air flow is not great enough to remove a significant amount of heat from the environment. Another solution has been to direct nozzles of compressed air towards the print head to cool the surface; often in this case the air flow is too forceful and can disrupt the dispersion of the ink onto the product. In view of the prior art systems and methods identified herein, there is a need for an improved system and method of cooling the ink-jet printers implemented on wire and cable extrusion or manufacturing lines.

BRIEF SUMMARY OF THE INVENTION

The present invention provides for print head cooling sleeve or jacket which may be assembled or slid over the print head (without obstructing the ink outlet or the connections to the main enclosure) and forces compressed air within the print head cooling sleeve, across the surfaces of the print head and exiting away from the printing mechanism, to cool the print head during use in a manufacturing line. The compressed air flowing within the print head cooling sleeve provides a source of cooler air to reduce the temperature of the print head as well as creating a layer of obstruction to reduce the convection from higher ambient temperatures and radiation from the extrusion line. The invention improves the reliability of the print head such that is does not need to be unclogged regularly (for a much longer time period than other methods attempted). Additionally, the print head cooling sleeve is oriented such that the cooling airflow does not disrupt the print legend application. As the print head cooling sleeve is not connected to an existing exhaust air conditioning source, the print head cooling sleeve may be controlled independently and separately as needed without affecting other processes.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood; however, that the invention is not limited to the precise arrangements and instrumentalities shown.

DETAILED DESCRIPTION OF THE EMBODIMENTS OF THE INVENTION

The following discussion is presented to enable a person skilled in the art to make and use the present invention. The general principles described herein may be applied to embodiments and applications other than those specifically detailed below without departing from the spirit and scope of the present invention. Therefore, the present invention is not intended to be limited to the embodiments expressly shown, but is to be accorded the widest possible scope of invention consistent with the principles and features disclosed herein.

Figure 1:
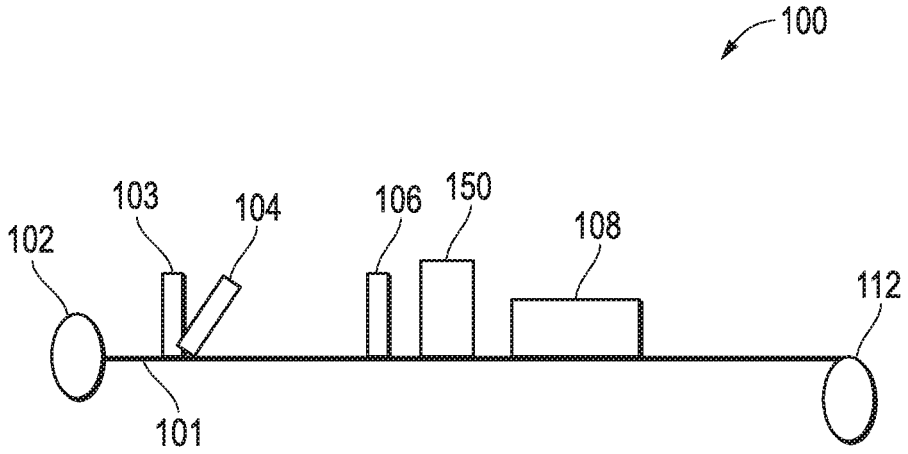
FIG. 1 is a diagram illustrating a system for printing of a legend on wire or cable during manufacture of the wire or cable in accordance with an embodiment of the invention.

Referring to FIG. 1, a diagram illustrating a system for printing of a legend on wire or cable during manufacture of the wire or cable in accordance with an embodiment of the present disclosure. In this embodiment, a standard payoff reel 102 to supply an internal conductor(s) 101, such as a copper or aluminum wire is provided in system 100. The standard payoff reel 102 supplies the internal conductor(s) 101 to an extruder 103 to apply an insulating material over the internal conductor(s) 101. Extruder 103 may be a single extruder head, a plurality of extruders, a cross head, a co-extrusion head or any combination thereof. The insulating material may be thermoset, thermoplastic, elastomeric, polymeric dielectric or a semiconductor compound or any combination thereof.

A first optional extruder 104 is also provided in system 100 to apply an additional layer of insulating material over the internal conductor(s) 101 that may comprise a thermoset, thermoplastic, elastomeric, polymeric dielectric or a semiconductor compound or any combination thereof. The first optional extruder 104 may also function in the system 100 to apply a further additional layer of material, such as, but not limited to Nylon, over the wire or cable to form an outer jacket.

A second optional extruder 106 may also be provided in system 100 to apply a further additional layer of thermoplastic or thermoset material thermoset, thermoplastic, elastomeric, polymeric dielectric or a semiconductor compound or any combination thereof such as, but not limited to, Nylon over the insulated wire or cable to form an outer jacket. Alternatively, second optional extruder 106 may be provided to apply additional insulating material over the insulated wire or cable to form an additional insulating layer. For example, second optional extruder 106 may be provided to apply an insulating material, such as PVC, over the insulated wire or cable. It is contemplated by the present invention that even further additional optional extruders may be provided for additional material application to the wire and cable.

After the insulating material is applied, the insulated wire or cable passes an ink printing system 150 for applying an ink legend to the wire or cable. After the ink legend is applied to the wire or cable, the insulated wire or cable is supplied to a cooling device 108 for cooling the applied insulating material over the wire or cable. In one embodiment, the cooling device 108 may be a water trough or similar device that contains a cooling material. The cooling device 108 functions to cool and lower the temperature of the insulating material over the wire or cable as it departs extruder 103 and/or first optional extruder 104 and/or second optional extruder 106 and enters the cooling device 108 by removing latent heat caused by extrusion in extruder 104 or the first optional extruder 104 or the second optional extruder 106. The cooling of insulating material provides a more stable polymeric state for later processing. In one embodiment, the insulating material is cooled to an ambient temperature, such as a temperature of less than 85 degrees Celsius.

After the wire or cable is cooled in the cooling device 108, a motor-driven reel 112 is provided to wind up the resulting wire or cable. The resulting wire or cable is reeled by the motor-driven reel 112 and wrapped in plastic film for distribution or storage.

Figure 2:
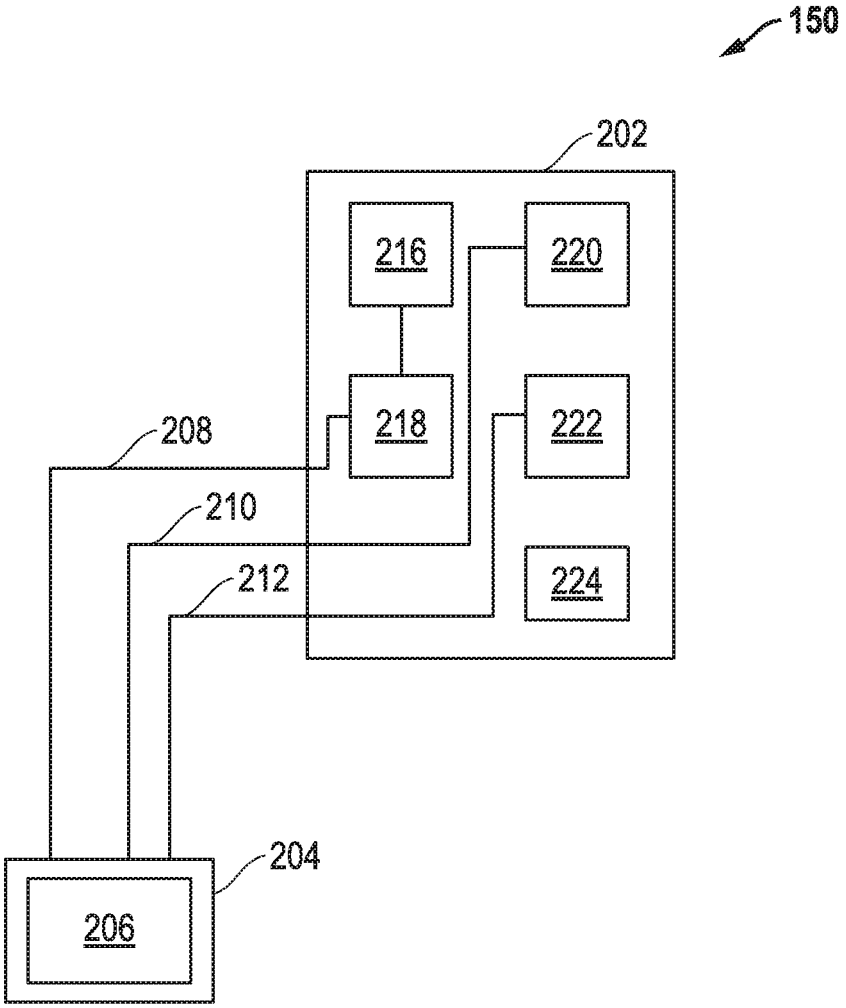
FIG. 2 is a diagram illustrating the ink printing system according to one embodiment of the invention.

Referring now to FIG. 2, an ink printing system according to one embodiment is disclosed. The ink printing system 150 includes three components: a main enclosure 202, a print head 206, and a print head cooling sleeve (or jacket) 204. The main enclosure 202 includes ink cartridges 216 to store the ink supply needed to print the legend on the wire or cable, mixing and pumping equipment 218 to send the ink to the print head 206, primary electronics 220 for powering, controlling, and programming the ink printing system 150, including the printer head 206, and a compressed air supply 222. In one embodiment, the compressed air supply 222 is a stand-alone component external from the main enclosure 202. In one embodiment, the print head 206 and the print head cooling sleeve (204) are mounted external of the main enclosure 202. The print head 206 prints the print legend in dot matrix lettering onto the wire or cable as the wire or cable passes by the ink printing system 150 after extrusion of the insulating material during the manufacturing processes.

The print head 206 and print head cooling sleeve 204, in one embodiment, are connected to the main enclosure 202 by a series or cables that are mounted on the rear of the main enclosure 202. The main enclosure 202 provides power and electronic control signals to the print head 206 through an electronic cable 212 and provides ink to the print head 206 through an ink cable 208. The main enclosure 202 also provides compressed air to the print head cooling sleeve 204 through an air cable 210. In another embodiment, the main enclosure 202 is connected to the print head 206 and print head cooling device 204 by a single thick cable. A wide variety of connection cables may be implemented without detracting from the spirit of the invention. The main enclosure 202 has an internal exhaust system 224 that protects the components of the main enclosure 202 from overheating. In one embodiment, the extrusion or manufacturing line may include an additional exhaust units located on each line to assist with cooling of the work area, the operator and the equipment, including the ink printing system 150. Cooling systems are necessary as the print heads 206 are very sensitive and prone to clogging, especially in warm environments. When temperatures are not optimal, the ink does not disperse properly and will block the outlet of the print head 206 requiring a technician to halt the manufacturing line and to disassemble and clean the print head 206. When ambient temperatures exceed 90° F., this maintenance operation may necessarily be performed multiple times an hour.

Figure 3:
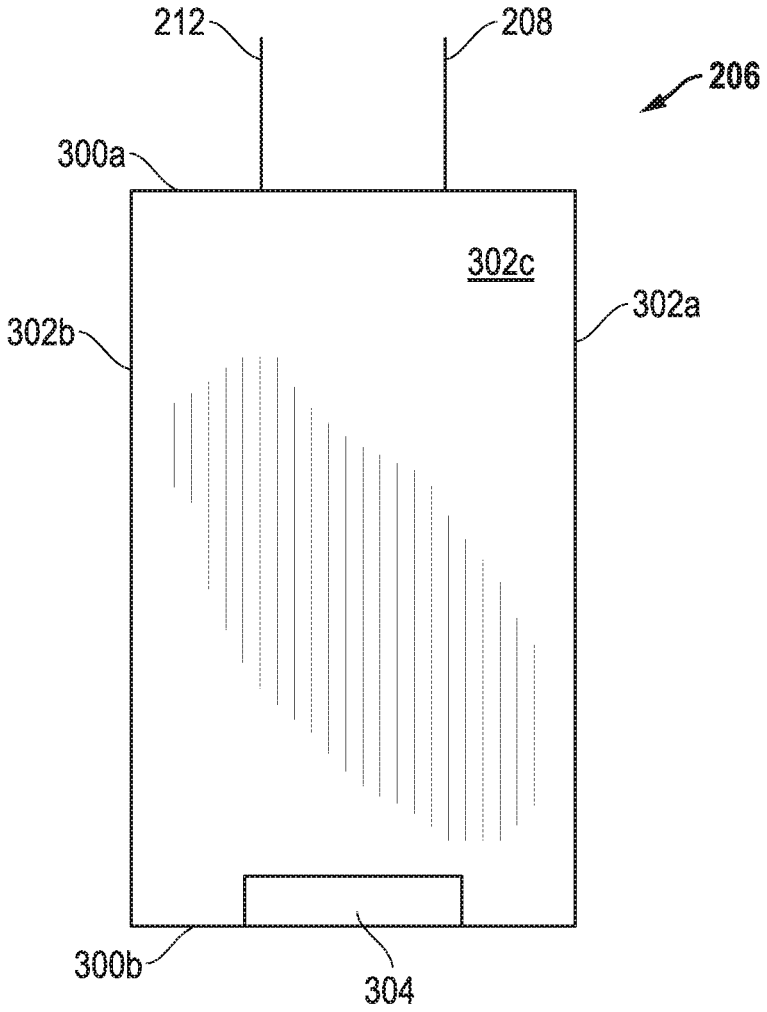
FIG. 3 is a diagram illustrating the print head according to one embodiment of the invention.
Figure 4:
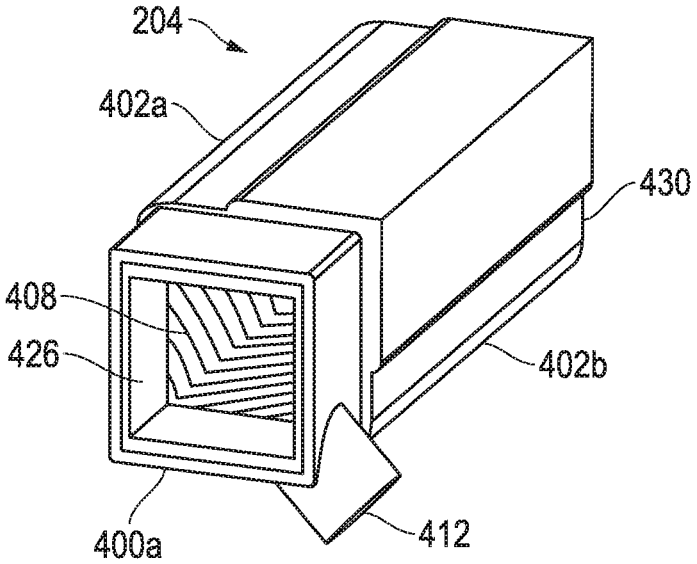
FIG. 4 is a perspective view of the back of a print head cooling sleeve according to one embodiment of the invention.
Figure 5:
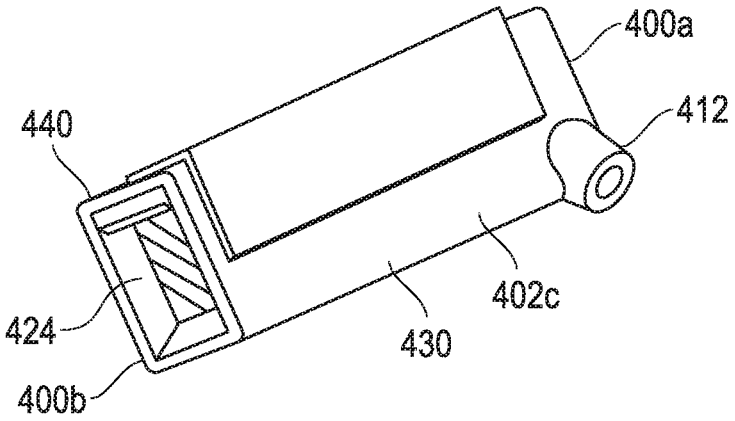
FIG. 5 is a perspective view of a print head cooling sleeve according to one embodiment of the invention.
Figure 6:
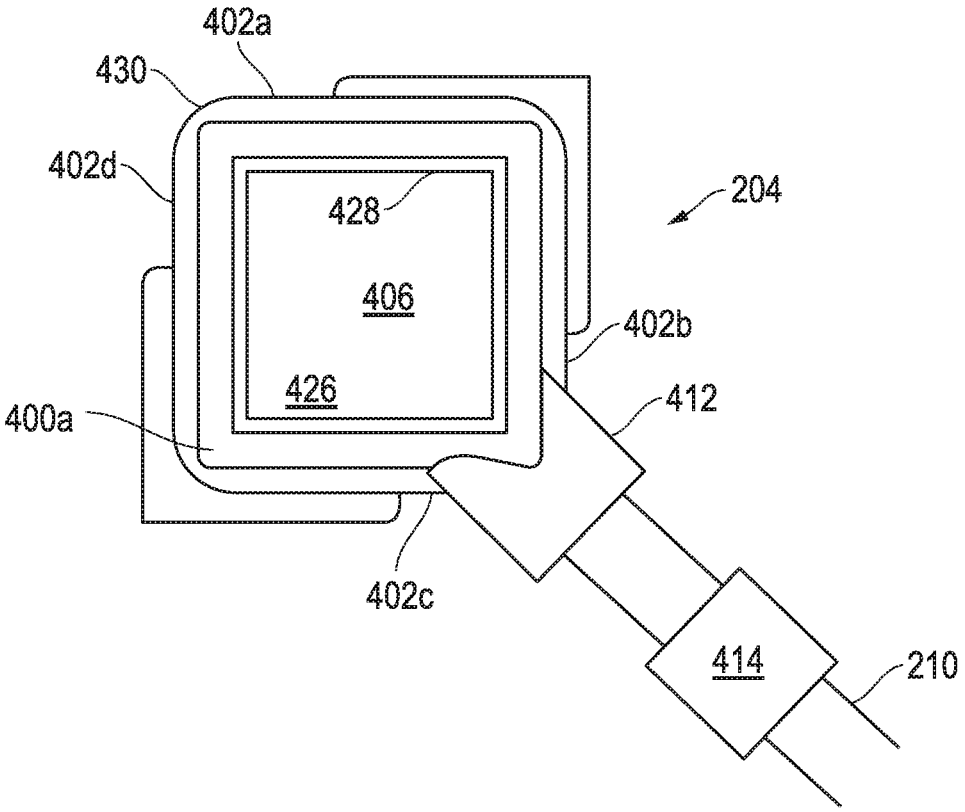
FIG. 6 is an end view of a print head cooling sleeve according to one embodiment of the invention
Figure 7:
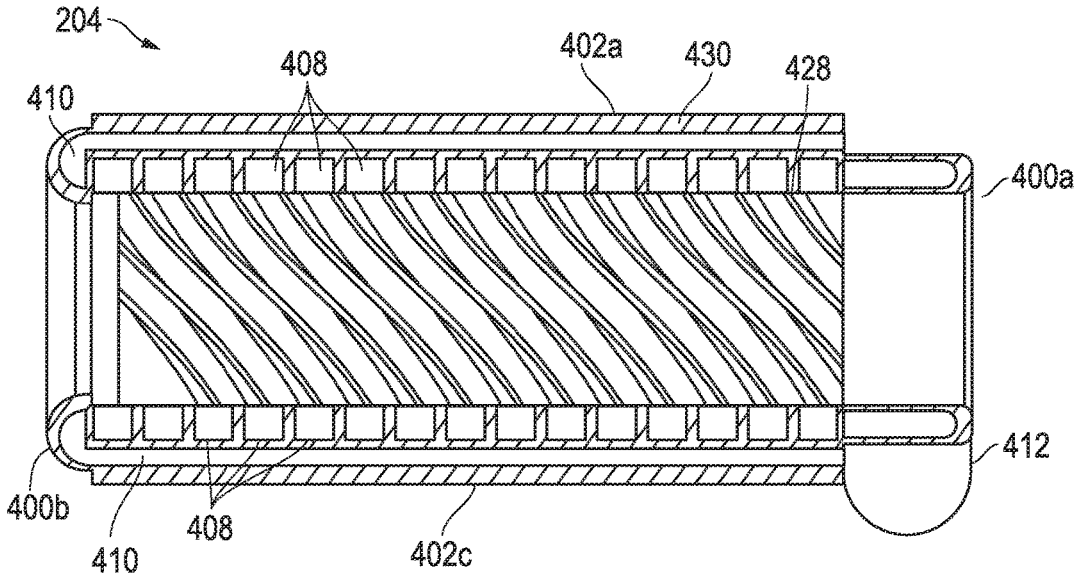
FIG. 7 is a cross-section view of a print head cooling sleeve according to one embodiment of the invention.
Figure 8:
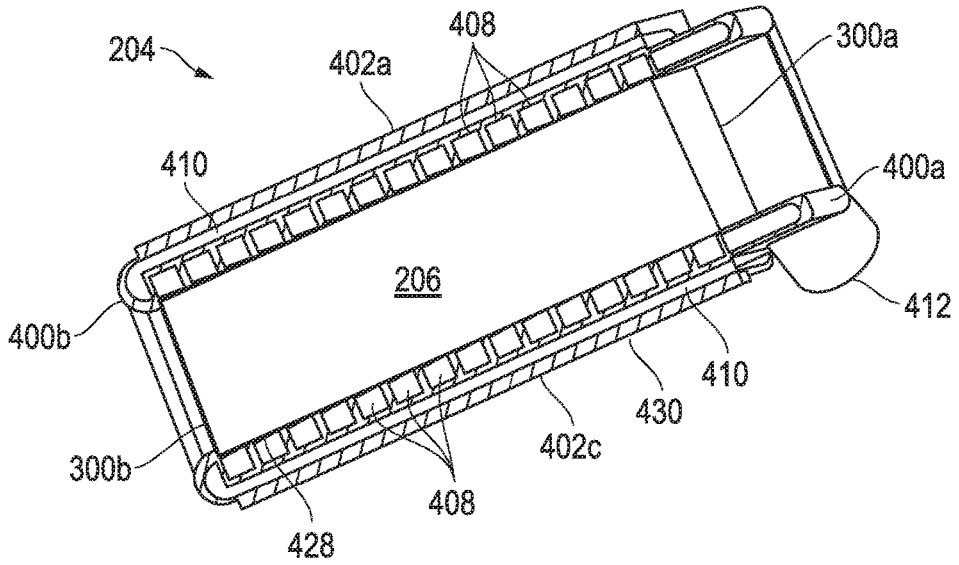
FIG. 8 is a cross-section view of a print head cooling sleeve and print head according to one embodiment of the invention.
Figure 9:
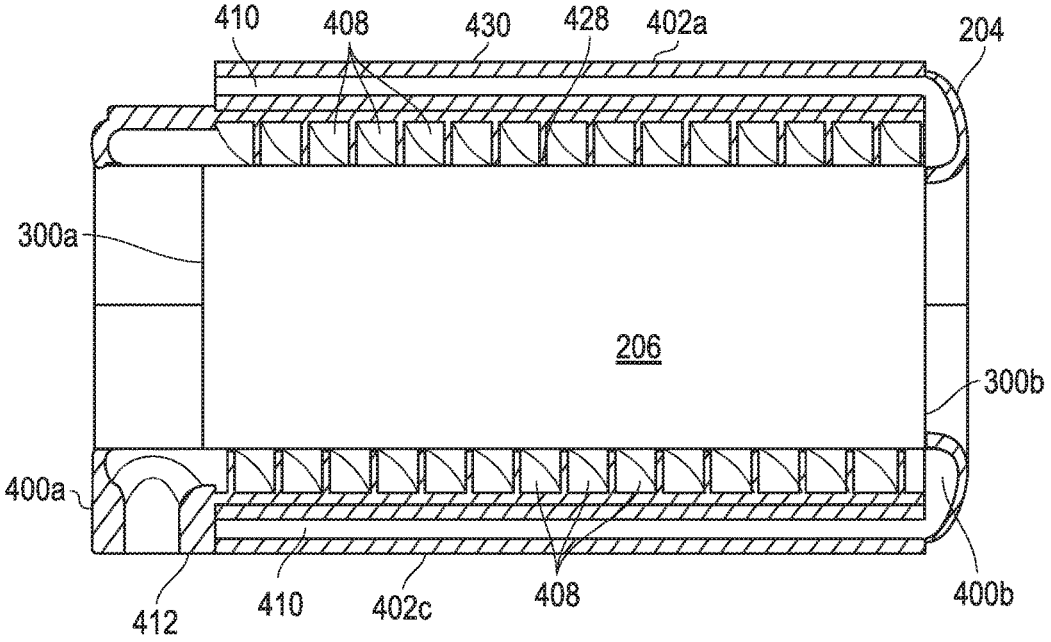
FIG. 9 is a cross-section view of a print head cooling sleeve according to one embodiment of the invention.
Figure 10:
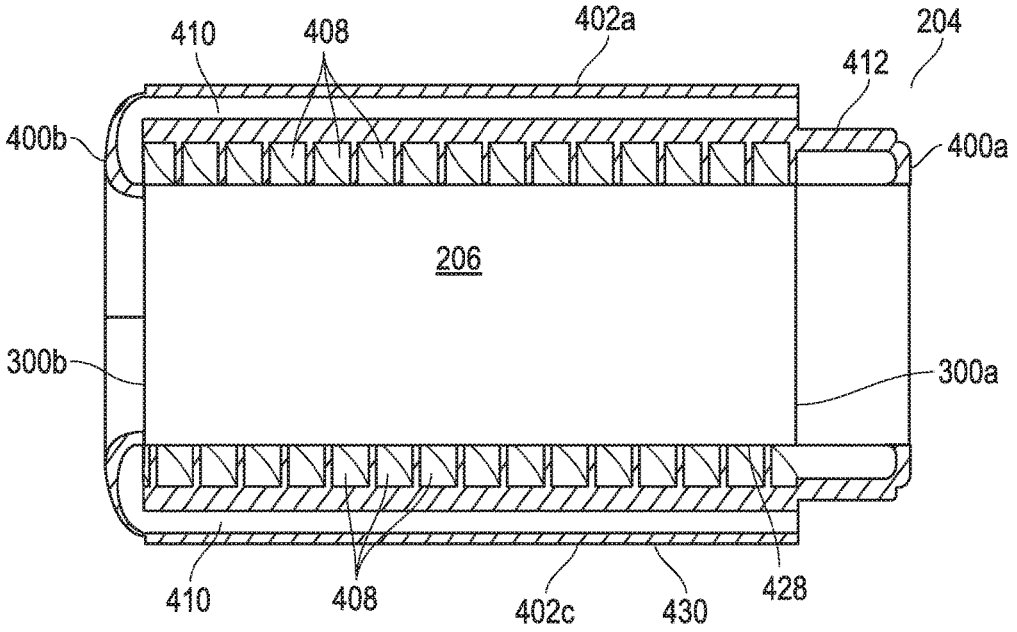
FIG. 10 is a cross-section view of a print head cooling sleeve according to one embodiment of the invention.

Referring now to FIG. 3, a print head according to one embodiment of the invention is disclosed. In one embodiment, the print head 206 is a rectangular device with two (2) substantially square surfaces 300*a-b* and four (4) substantially rectangular surfaces 302*a-d* (rectangular surface 302*d* not shown), however, a wide variety of print head shapes may be implemented without detracting from the spirit of the invention, including cylindrical or a triangular prism. In one embodiment, the substantially square surfaces 300*a-b* are perpendicular to the substantially rectangular surfaces 302*a-d*, however, a wide variety of attachment angles may be implemented without detracting from the spirit of the invention, including but not limited to, forty-five degrees from the substantially rectangular surfaces. The front or lower substantially square surface 300*b* includes the printing mechanism 304 or ink outlets that print the ink on the wire or cable that passes below the printing mechanism 304 and is typically identified as the front of the print head 206. The upper substantially square surface 300*a* includes connections for the electronic cable 212 and ink cable 208 allowing access to the print mechanism 304 and is identified as the back of the print head 206. The four substantially rectangular surfaces 302*a-d* form the edges of the enclosure of the print head 206. Signals representing how often to print and what to print are transmitted from the main enclosure 202 over the electronic cable 212 to the print head 206. Variations in how often to print and variations in the print legend are controlled by the main enclosure 202. The selected, and possibly mixed, ink from the main enclosure 202 is sent from the main enclosure to the print head 206 through the ink cable 208. The ink is then transferred to the printing mechanism 304 for printing on the wire or cable.

Referring now to FIGS. 4-10, a print head cooling sleeve according to one embodiment is shown. The print head cooling sleeve 204, or jacket, is located around the surfaces 300*a-b* and 302*a-d* of the print head 206. The print head cooling sleeve 204 is a rectangular device with two (2) substantially square ends 400*a-b* and four (4) substantially rectangular surfaces 402*a-d* where the long edges of the rectangular surfaces 402*a-d* are connected to another long edge of the rectangular surfaces 402*a-d* at a substantially perpendicular angle, however, a wide variety of print head cooling sleeve shapes may be implemented without detracting from the spirit of the invention, including cylindrical or a triangular prism. In one embodiment, the substantially square ends 400*a-b* are perpendicular to the substantially rectangular surfaces 402*a-d*, however, a wide variety of attachment angles may be implemented without detracting from the spirit of the invention, including but not limited to, forty-five degrees from the substantially rectangular surfaces. The size and shape of the print head cooling sleeve 204 conforms to the size and shape of the print head 206. The print head cooling sleeve 204 slides over the front 300*b* of or is assembled around the print head 206, leaving the back 300*a* of the print head 206 open to form a cable opening 426 to avoid damage to the electronic cable 212 and the ink cable 208 that attaches the print head 206 to the main enclosure 202. The front 400*b* of the print head cooling sleeve 204 is unobstructed except for a small rim 440 that holds the print head 206 in place forming an ink outlet opening 424. The small rim 440 impedes the print head 206 from passing completely through the print head cooling sleeve 204 when the print head 206 is inserted into the print head cooling sleeve 204. All sides 302*a-d* of the print head 206 that are perpendicular to the front surface 302*b* are enclosed in the print head cooling sleeve 204.

In one embodiment, the print head cooling sleeve 204 is a substantially rectangular container with a smaller substantially rectangular void 406 within the substantially rectangular container. The print head 206 is inserted into the substantially rectangular void 406. In one embodiment, the size of the print head 206 is marginally smaller than the size of the substantially rectangular void 406. A wide variety of shapes and sizes of the print head cooling sleeve 204 may be implemented without detracting from the spirit of the invention. Typically, the print head cooling sleeve 204 is substantially the same shape and marginally larger than the print head 206.

The print head cooling sleeve has an exterior 430 and an interior 428. The interior 428 of the print head cooling sleeve 204 forms the substantially rectangular void 406. The interior 428 of the print head cooling sleeve 204 includes channels 408 that come into contact with, or nearly contacts, the print head 206 surface 302*a-d* once it is inserted into the print head cooling sleeve 204. In one embodiment, the channel 408 has an open end that faces the rectangular void 406 and the open end of the channel 408 comes into contact with, or nearly contacts, the print head 206 surface 302*a-d* once it is inserted into the print head cooling sleeve 204. The channels 408 wrap helically around the print head 206 surface 302*a-d* and then connect together to an exhaust channel 410 that exits at the back of the print head 206 near the print head 206 electronic cable 212 and ink cable 208. A wide variety of channel types may be implemented without detracting from the spirit of the invention, including channels in a U-shape. The channels 408 are used to center the print head 206 evenly and snugly hold the print head 206, while still allowing air to be evenly distributed along the substantially rectangular surfaces 302*a-d* of the print head 206. In one embodiment, the channels 408 do not allow air to be distributed along the substantially square surfaces 300*a-b* of the print head 206.

Located at the rear of the print head cooling sleeve 204 is an inlet 412 for a compressed air supply to be attached through the air cable 210, in-line with a regulator 414 to control the flow of air according to one embodiment. The regulator 414 allows for a fine control of the flow rate, allowing for efficient compressed air consumption. When turned on, the air will be distributed evenly around the inner perimeter, and then be directed into the channels 408. The air will flow through the channels 408, forward towards the front 300*b* of the print head 206. While it is making contact with the surfaces 302*a-d* of the print head 206, the air, which is relatively cooler than the ambient temperature of the environment, will lower the surface temperature of the print head 206 through convection. When the air reaches the end of the channels 408 at the front 300*b* of the print head 206, the air will be directed out (away from the print head 206), and then back (towards the rear 300*a* of the print head 206) through the exhaust channel 410 that is located next to the exterior of the print head cooling sleeve 204. The exhaust channel 410 flows parallel to the length of the print head cooling sleeve 204 and discharges the air through the back 400*a* of the print head cooling sleeve 204. The orientation of the exhaust is such that it will not affect the deposition of the ink onto the wire or cable, eliminating a source of print legend distortion. In one embodiment, the exhaust channel 410 is formed as a portion of the inner surface of the print head cooling jacket 204.

The print head cooling sleeve 204 also reduces the heat transfer of the environment to the print head 206 by separating the majority of the print head 206 surface 302*a-d* from its surroundings with a jacket of air that is at a lower temperature than the ambient temperature and one in which the air is constantly being displaced.

Figure 11:
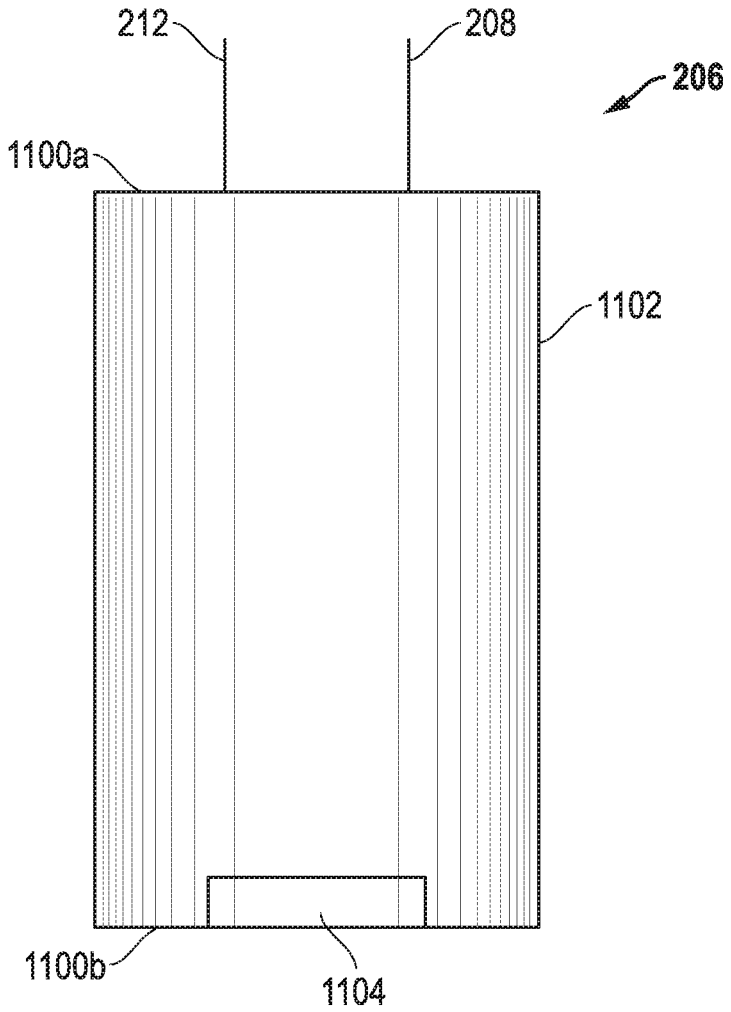
FIG. 11 is a diagram illustrating the print head according to one embodiment of the invention.
Figure 12:
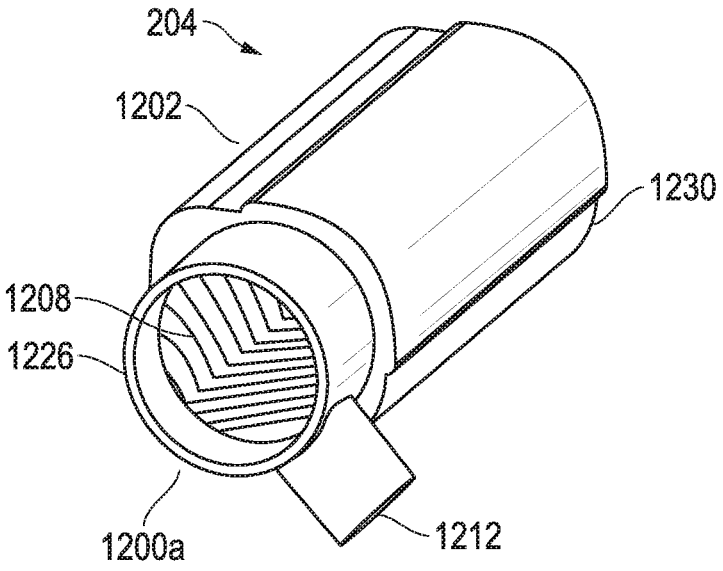
FIG. 12 is a perspective view of the back of a print head cooling sleeve according to one embodiment of the invention.
Figure 13:
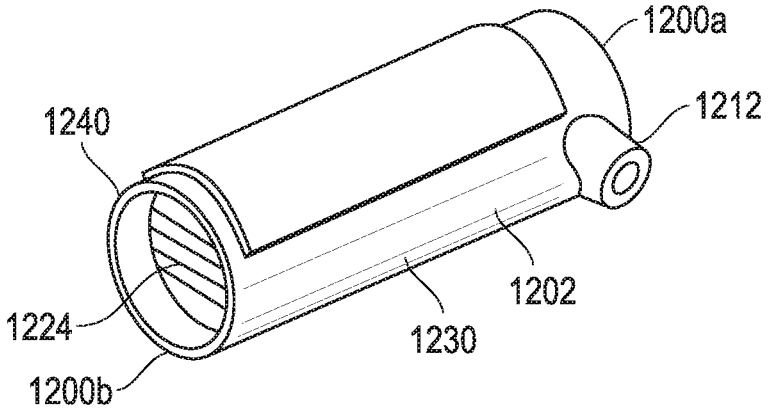
FIG. 13 is a perspective view of a print head cooling sleeve according to one embodiment of the invention.
Figure 14:
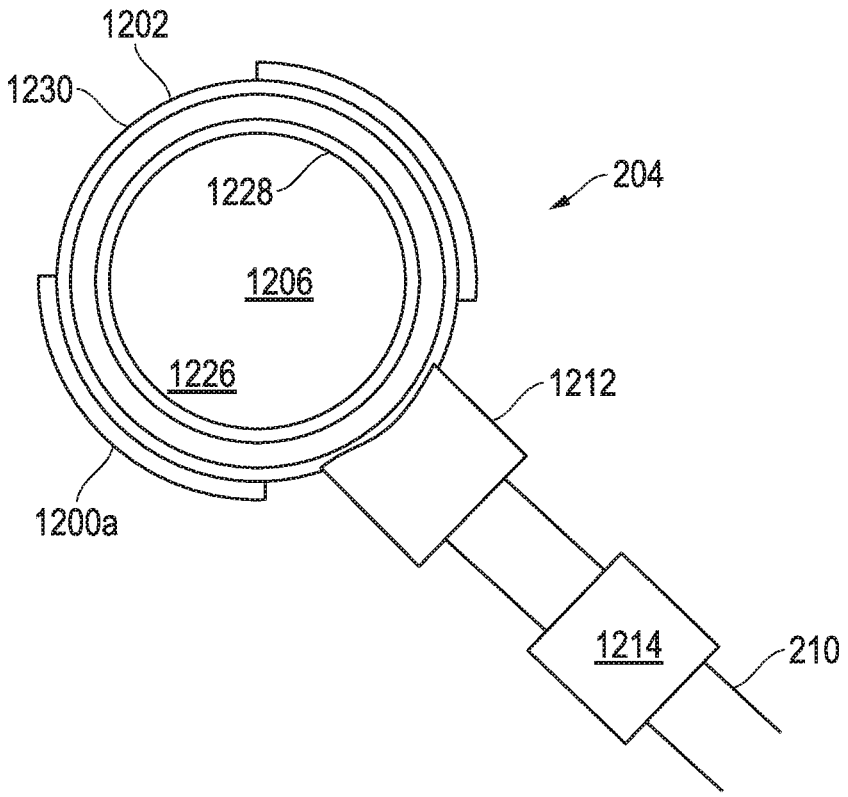
FIG. 14 is an end view of a print head cooling sleeve according to one embodiment of the invention
Figure 15:
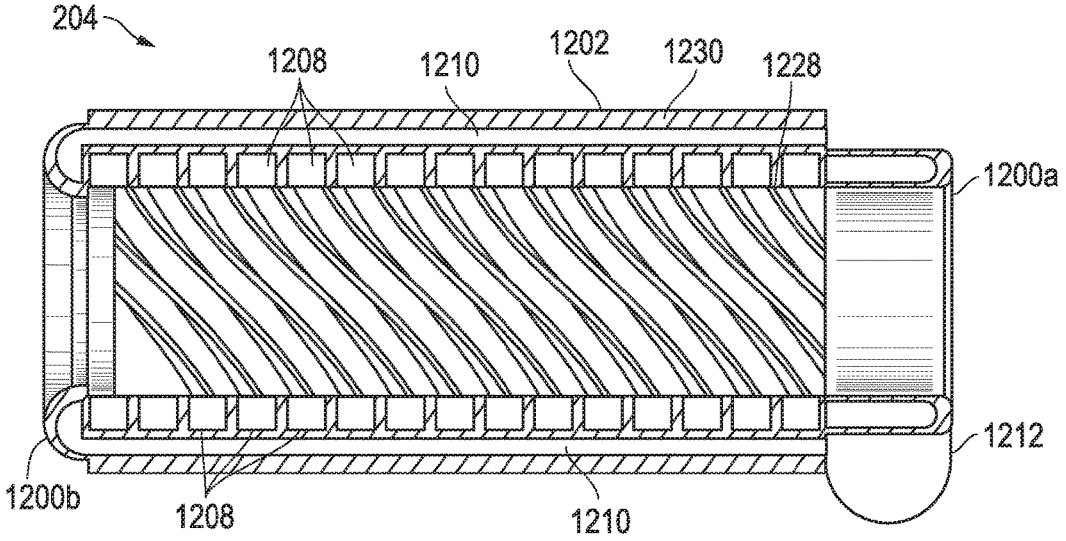
FIG. 15 is a cross-section view of a print head cooling sleeve according to one embodiment of the invention.
Figure 16:
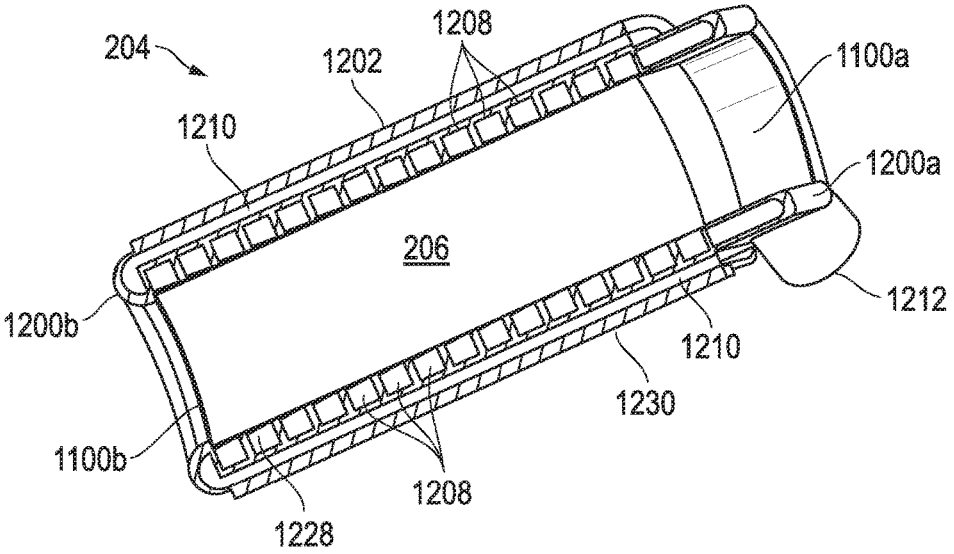
FIG. 16 is a cross-section view of a print head cooling sleeve and print head according to one embodiment of the invention.
Figure 17:
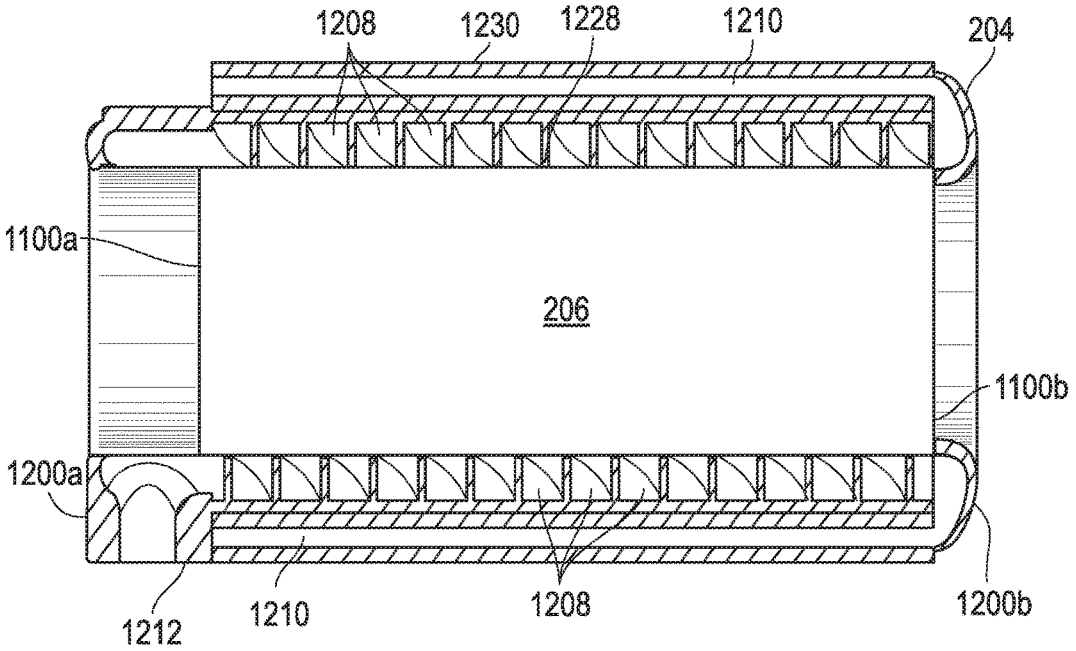
FIG. 17 is a cross-section view of a print head cooling sleeve according to one embodiment of the invention.
Figure 18:
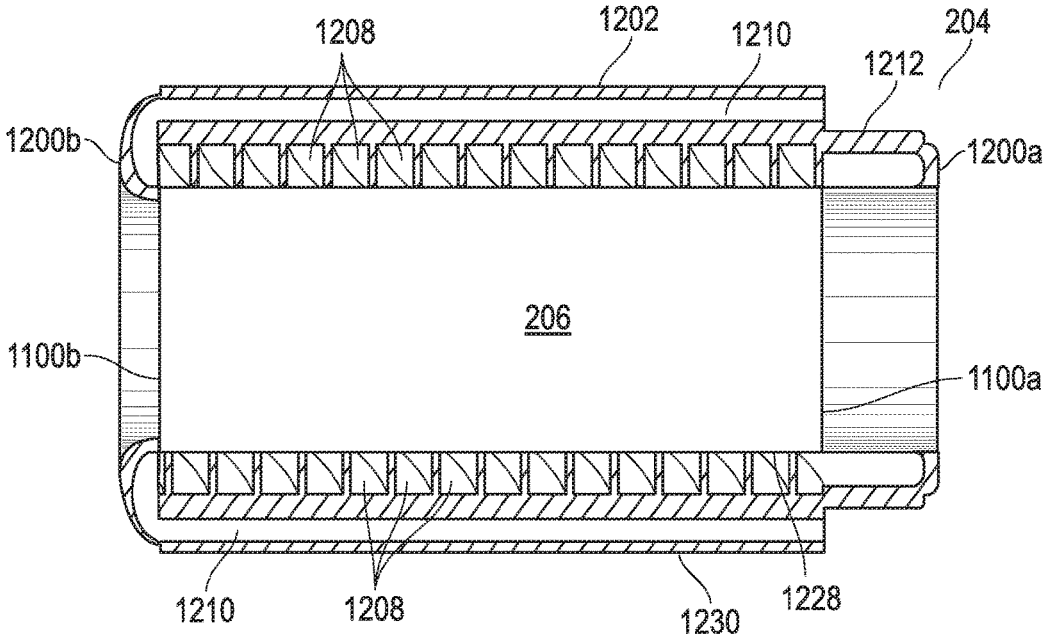
FIG. 18 is a cross-section view of a print head cooling sleeve according to one embodiment of the invention.

Referring now to FIG. 11, a print head according to one embodiment of the invention is disclosed. The print head 206 is a cylindrical device with two (2) substantially circular surfaces 1100*a-b* and one substantially tubular surface 1102. In one embodiment, the substantially circular surfaces 1100*a-b* are perpendicular to the substantially tubular surface 1102, however, a wide variety of attachment angles may be implemented without detracting from the spirit of the invention, including but not limited to, forty-five degrees from the substantially tubular surface. The front or lower substantially circular surface 1100*b* includes the printing mechanism 1104 or ink outlets that print the ink on the wire or cable that passes below the printing mechanism 1104 and is typically identified as the front of the print head 206. The upper substantially circular surface 1100*a* includes connections for the electronic cable 212 and ink cable 208 allowing access to the print mechanism 1104 and is identified as the back of the print head 206. The substantially tubular surface 1102 forms the enclosure of the print head 206. Signals representing how often to print and what to print are transmitted from the main enclosure 202 over the electronic cable 212 to the print head 206. Variations in how often to print and variations in the print legend are controlled by the main enclosure 202. The selected, and possibly mixed, ink from the main enclosure 202 is sent from the main enclosure to the print head 206 through the ink cable 208. The ink is then transferred to the printing mechanism 304 for printing on the wire or cable.

Referring now to FIGS. 12-19, a print head cooling sleeve according to another embodiment is shown. The print head cooling sleeve 204, or jacket, is located around the circular and tubular surfaces 1100*a-b* and 1102 of the print head 206. The print head cooling sleeve 204 is a cylindrical device with two (2) substantially circular ends 1200*a-b* and one substantially tubular surface 1202. In one embodiment, the substantially circular end 1200*a-b* are perpendicular to the substantially tubular surface 1202, however, a wide variety of attachment angles may be implemented without detracting from the spirit of the invention, including but not limited to, forty-five degrees from the substantially rectangular surfaces. The print head cooling sleeve 204 slides over the front 1100*b* of or is assembled around the print head 206, leaving the back 1100*a* of the print head 206 open to form a cable opening 1226 to avoid damage to the electronic cable 212 and the ink cable 208 that attaches the print head 206 to the main enclosure 202. The front 1200*b* of the print head cooling sleeve 204 is unobstructed except for a small rim 1240 that holds the print head 206 in place forming an ink outlet opening 1224. The small rim 1240 impedes the print head 206 from passing completely through the print head cooling sleeve 204 when the print head 206 is inserted into the print head cooling sleeve 204. The tubular side 1102 of the print head 206 and the front surface 1102*b* are enclosed in the print head cooling sleeve 204.

In one embodiment, the print head cooling sleeve 204 is a substantially cylindrical container with a smaller substantially cylindrical void 1206 within the substantially cylindrical container. The print head 206 is inserted into the substantially cylindrical void 1206. In one embodiment, the size of the print head 206 is marginally smaller than the size of the substantially cylindrical void 1206. A wide variety of shapes and sizes of the print head cooling sleeve 204 may be implemented without detracting from the spirit of the invention. Typically, the print head cooling sleeve 204 is substantially the same shape and marginally larger than the print head 206.

The print head cooling sleeve has an exterior 1230 and an interior 1228. The interior 1228 of the print head cooling sleeve 204 forms the substantially cylindrical void 1206. The interior 1228 of the print head cooling sleeve 204 includes channels 1208 that come into contact with, or nearly contacts, the print head 206 surface 1102 once it is inserted into the print head cooling sleeve 204. In one embodiment, the channel 1208 has an open end that faces the substantially cylindrical void 1206 and the open end of the channel 1208 comes into contact with, or nearly contacts, the print head 206 surface 1102 once it is inserted into the print head cooling sleeve 204. The channels 1208 wrap helically around the print head 206 surface 1102 and then connect together to an exhaust channel 1210 that exits at the back of the print head 206 near the print head 206 electronic cable 212 and ink cable 208. A wide variety of channel types may be implemented without detracting from the spirit of the invention, including channels in a U-shape. The channels 1208 are used to center the print head 206 evenly and snugly hold the print head 206, while still allowing air to be evenly distributed along the substantially cylindrical surface 302 of the print head 206. In one embodiment, the channels 1208 do not allow air to be distributed along the substantially circular surfaces 1100*a-b* of the print head 206.

Located at the rear of the print head cooling sleeve 204 is an inlet 1212 for a compressed air supply to be attached through the air cable 210, in-line with a regulator 1214 to control the flow of air according to one embodiment. The regulator 1214 allows for a fine control of the flow rate, allowing for efficient compressed air consumption. When turned on, the air will be distributed evenly around the inner perimeter, and then be directed into the channels 1208. The air will flow through the channels 1208, forward towards the front 1100*b* of the print head 206. While it is making contact with the surface 1102 of the print head 206, the air, which is relatively cooler than the ambient temperature of the environment, will lower the surface temperature of the print head 206 through convection. When the air reaches the end of the channels 1208 at the front 1100*b* of the print head 206, the air will be directed out (away from the print head 206), and then back (towards the rear 1100*a* of the print head 206) through the exhaust channel 1210 that is located next to the exterior of the print head cooling sleeve 204. The exhaust channel 1210 flows parallel to the length of the print head cooling sleeve 204 and discharges the air through the back 1200*a* of the print head cooling sleeve 204. The orientation of the exhaust is such that it will not affect the deposition of the ink onto the wire or cable, eliminating a source of print legend distortion. In one embodiment, the exhaust channel 1210 is formed as a portion of the inner surface of the print head cooling jacket 204.

The print head cooling sleeve 204 also reduces the heat transfer of the environment to the print head 206 by separating the majority of the print head 206 surface 1102 from its surroundings with a jacket of air that is at a lower temperature than the ambient temperature and one in which the air is constantly being displaced.

The exterior of the print head cooling sleeve 204 includes a connection mechanism, allowing the print head cooling sleeve 204 to be connected to existing machinery, including attachment to the print head mounting currently in use. A wide variety of connection techniques may be implemented without detracting from the spirit of the invention. The print head cooling sleeve 204 may be mounted just as the standalone print head 206 normally would be mounted, requiring no alterations to the current mounting methods and equipment.

Although the invention is described herein with reference to specific embodiments, various modifications and changes can be made without departing from the scope of the invention as set forth in the claims below. Accordingly, the specification and figures are to be regarded in an illustrative rather than a restrictive sense, and all such modifications are intended to be included within the scope of the invention. Any benefits, advantages, or solutions to problems that are described herein with regard to specific embodiments are not intended to be construed as a critical, required, or essential feature or element of any or all the claims.

From time-to-time, the invention is described herein in terms of these example embodiments. Description in terms of these embodiments is provided to allow the various features and embodiments of the invention to be portrayed in the context of an exemplary application. After reading this description, it will become apparent to one of ordinary skill in the art how the invention can be implemented in different and alternative environments. Unless defined otherwise, all technical and scientific terms used herein have the same meaning as is commonly understood by one of ordinary skill in the art to which this invention belongs.

The preceding discussion is presented to enable a person skilled in the art to make and use the invention. The general principles described herein may be applied to embodiments and applications other than those detailed below without departing from the spirit and scope of the invention as defined by the appended claims. The invention is not intended to be limited to the embodiments shown, but is to be accorded the widest scope consistent with the principles and features disclosed herein.

In addition, while a particular feature of the invention may have been disclosed with respect to only one of several embodiments, such feature may be combined with one or more other features of the other embodiments as may be desired. It is therefore, contemplated that the claims will cover any such modifications or embodiments that fall within the true scope of the invention.

The various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one", "one or more" or the like; and adjectives such as "conventional", "traditional", "normal", "standard", "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more", "at least", "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Unless stated otherwise, terms such as "first" and "second" are used to arbitrarily distinguish between the elements such terms describe. Thus, these terms are not necessarily intended to indicate temporal or other prioritization of such elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in the field or any related fields are intended to be within the scope of the following claims.

The invention claimed is:

1. An apparatus for cooling a print head implemented on a wire and cable manufacturing line, the apparatus comprising:

a sleeve, wherein the sleeve has an internal portion and an external portion and wherein the sleeve forms an internal void marginally larger than the size of the print head and wherein the sleeve further comprises:

an elongated surface;

a front surface connected to the elongated surface, wherein the front surface comprises an ink outlet opening;

a rear surface connected to the elongated surface, wherein the rear surface comprises a cable opening;

a channel connected to the internal portion of the sleeve, wherein the channel comprises an open side facing the internal void and wherein the channel on the internal portion of the sleeve extends from the rear to the front of the sleeve;

an air inlet compartment in communication with the channel and enclosed by the rear surface;

an air inlet in communication with the air inlet compartment; and an exhaust channel connected to the sleeve and extending from the front to the rear along the elongated surface and connected to the channel at the front of the sleeve.

2. The apparatus of claim 1, wherein the channel is a series of channels.

3. The apparatus of claim 1, wherein the channel is a U-shaped channel.

4. The apparatus of claim 1 further comprising a mounting apparatus attached to the external portion of the sleeve.

5. The apparatus of claim 1, wherein the air inlet is capable of being connected to a compressed air supply.

6. The apparatus of claim 1, wherein the ink outlet opening is smaller than a front section of the print head.

7. The apparatus of claim 6, wherein the ink outlet opening does not impede the distribution of ink from the print head.

8. The apparatus of claim 1, wherein the channel is wrapped helically along the internal portion of the sleeve.

9. The apparatus of claim 1, wherein the exhaust channel is connected to the internal portion of the sleeve.

10. The apparatus of claim 1, wherein the exhaust channel is connected to the external portion of the sleeve.

11. The apparatus of claim 1, wherein the sleeve is a rectangular sleeve.

12. The apparatus of claim 1, wherein the sleeve is a cylindrical sleeve.

13. A system for cooling a print head, the system comprising:

a manufacturing line, wherein wire and cable are manufactured on the manufacturing line;

an ink printing system connected to the manufacturing line, wherein the ink printing system prints information on the wire or cable, the ink printing system further comprising:

a compressed air supply;

a main enclosure, wherein the main enclosure comprises an ink supply, pumping equipment, and electronics for controlling the ink printing system;

an electronic cable connected to the main enclosure, the electronic cable communicating with the electronics;

an air hose connected to the compressed air supply, the air house for transferring compressed air from the compressed air supply;

an ink hose connected to the main enclosure, the ink house for transferring the ink supply from the main enclosure;

a print head connected to the electronic cable and ink house, the print head for printing ink on the wire and cable; and a sleeve, wherein the sleeve has an internal portion and an external portion and wherein the sleeve forms an internal void marginally larger than the size of the print head;

wherein the print head is located within the internal void;

wherein the sleeve further comprises:

an elongated surface;

a front surface connected to the elongated surface, wherein the front surface comprises an ink outlet opening;

a rear surface connected to the elongated surface, wherein the rear surface comprises a cable opening;

a channel connected to the internal portion of the sleeve, wherein the channel comprises an open side facing the internal void and wherein the channel on the internal portion of the sleeve extends from the rear to the front of the sleeve;

an air inlet compartment in communication with the channel and enclosed by the rear surface;

an air inlet in communication with the air inlet compartment and the air hose; and an exhaust channel connected to the sleeve and extending from the front surface to the rear surface along the elongated surface and connected to the channel at the front of the sleeve.

14. The system of claim 13, wherein compressed air is transferred from the main enclosure to through the air hose to the channel.

15. The system of claim 14, wherein the compressed air passes through the channel and contacts the print head.

16. The system of claim 15, wherein the compressed air passing through the channel cools the print head.

17. The system of claim 15, wherein the compressed air exits through the exhaust channel after passing through the channel.

18. The system of claim 13, wherein the channel is a series of channels.

19. The system of claim 13, wherein the channel is a U-shaped channel.

20. The system of claim 13 further comprising a mounting apparatus attached to the external portion of the rectangular sleeve.

21. The system of claim 13, wherein the ink outlet opening does not impede the distribution of ink from the print head.

22. The system of claim 13, wherein the channel is wrapped helically along the internal portion of the rectangular sleeve.

23. The system of claim 13, wherein the sleeve is a rectangular sleeve.

24. The system of claim 13, wherein the sleeve is a cylindrical sleeve.

25. The system of claim 13, wherein the compressed air supply is located within the main enclosure.

* * * * *